United States Patent [19]

Goldman et al.

[11] 4,191,376

[45] Mar. 4, 1980

[54] HIGHLY SECURE PLAYING CARDS FOR INSTANT LOTTERY AND GAMES

[75] Inventors: Max Goldman; Carl Alexoff, both of Cherry Hill, N.J.

[73] Assignee: Systems Operations, Inc., Princeton, N.J.

[21] Appl. No.: 763,639

[22] Filed: Jan. 28, 1977

Related U.S. Application Data

[63] Continuation-in-part of Ser. No. 580,604, May 27, 1975, abandoned.

[51] Int. Cl.[2] ..... A63B 71/06

[52] U.S. Cl. ..... 273/139; 235/385; 340/149 A

[58] Field of Search ..... 273/139, 138 A; 235/385; 340/149 A

[56] References Cited

U.S. PATENT DOCUMENTS

| | | | |
|---|---|---|---|
| 2,023,829 | 12/1935 | Wright | 273/139 X |
| 2,640,279 | 6/1953 | Dolinsky | 273/139 UX |
| 3,833,795 | 9/1974 | Shoshani et al. | 273/138 A UX |
| 3,917,276 | 11/1975 | Green Barg | 273/139 |
| 3,940,124 | 2/1976 | Johnsen | 273/139 X |
| 3,956,049 | 5/1976 | Johnsen | 273/139 X |

*Primary Examiner*—Richard C. Pinkham
*Assistant Examiner*—Arnold W. Kramer
*Attorney, Agent, or Firm*—Morton C. Jacobs

[57] ABSTRACT

Tickets for an instant lottery are imprinted with lottery numbers and serial numbers that are uniquely related and the lottery numbers are covered from view until after purchase, to provide control and distribution of winners and a high degree of security from fraud. By means of computerized fabrication a low cost and high security ticket is achieved. Playing cards for other games are also inexpensively fabricated.

6 Claims, 7 Drawing Figures

HIGHLY SECURE PLAYING CARDS FOR INSTANT LOTTERY AND GAMES

This application is a continuation-in-part of copending application Ser. No. 580,604, filed May 27, 1975, and now abandoned.

BACKGROUND OF THE INVENTION

This invention relates to games and contests and particularly to the construction of tickets used therein and to a method of fabricating such tickets.

A large number and variety of legal lotteries and contests exist in which participants may win a prize. Private groups conduct contests for charitable purposes, commercial enterprises operate games of chance and several states sponsor and supervise lotteries in their states and have established networks of selling agents to promote a wide distribution of lottery tickets throughout their state. In a conventional type of lottery the participant purchases, or in a promotional contest, game or lottery is given, a lottery ticket inscribed with a lottery number. Instructions, announcements and indicia on the ticket of the operative source of the ticket may also appear. Each ticket bears a unique lottery number which distinguishes it from every other lottery ticket in the same game or contest. At a later pre-established date, when additional lottery tickets in the same game are no longer offered for sale, a winning number is determined by a random chance selection from a population of numbers matching the population of lottery numbers in distribution, or the winning lottery number is determined in a manner whereby accurate prediction of the winning number is highly improbable, e.g., the last six digits in the U.S. Treasury balance as printed in the daily newspaper on a predetermined date. In either case, the winning number, as such, is nonexistent until its moment of selection or determination. A holder of a lottery ticket bearing the winning number presents the ticket to the game operator to collect his prize.

Security is provided in state lotteries by generating lottery numbers under computer control. The serial number, which is printed on each ticket to identify the game, ticket lot and the individual ticket, is converted internally by the computer into a sequential series of intermediate numbers. In a second computerized step a complex computer algorithm based on a series of operators is employed to act on the intermediate numbers to develop lottery numbers (which form the bases for winning the lottery) that are printed on the ticket along with its paired serial number under the computer's direction. The relation between each ticket's serial number and its associated lottery number, for practical purposes, cannot be deciphered by those who do not know the algorithm. Any attempt to alter or change lottery numbers may be detected by the computer operating in accordance with the algorithm when the interrelationship between lottery and serial number is tested prior to payment of prize awards. Thereby, a high security system is achieved.

Another type of lottery that is used is called an "instant" lottery because the winning lottery number is known before the ticket is sold, so that a player can know whether he has won or lost within a few moments after his purchase. In such an instant lottery, the winning lottery numbers (or other indicia) are selected or determined and listed by the operator of the lottery prior to the sale of lottery tickets and are made known or available to players prior to their purchases of tickets. The list of winning numbers and associated prizes may be posted publicly or printed on the front or back face of the ticket. However, the lottery number (or other indicia) printed on the ticket is concealed, e.g., by an opaque covering such as paper that can be torn off to reveal the number, or a removable coating or metal foil that covers the number, or special printing inks are used, such as those that change under applied heat or special agent. A ticket's lottery number, which determines whether the ticket holder is a winner (or loser), does not become apparent to the player (or to the ticket seller) until after purchase, the ticket is acted upon by an external stimulus or agent to reveal the true number (e.g., by removing the covering to expose the lottery number to view). When transformed to an intelligible state, this ticket lottery number is compared against the list of winning numbers or other indicia; a matching of indicia entitles the ticket holder to a prize.

For security in an instant lottery (one wherein the winning numbers are known to the public when the ticket is purchased) concealment or disguise is provided for the individual lottery number imprinted on each ticket. This inherent feature of the ticket must be coupled with external means to quickly and easily expose the lottery number so that immediate comparison can be made between the ticket lottery number and a listing of winning numbers. The process of transformation whereby the lottery number becomes intelligible must be irreversible such that the selling agent or the purchaser is unable to restore the ticket to its original condition without tell-tale signs of alteration. Thus, a second use or sale of a ticket is precluded. Techniques for concealment or disguise of the lottery number are known in the art.

If the prize has a high monetary value, the winning ticket generally must be presented to the game operator for collection of the prize; however, in some contests, small prizes may be paid immediately to the winner by the ticket selling agent. These procedures for fast payment in instant lotteries have the advantage of stimulating player interest. But the shortened time periods before payment present risks of financial loss to the game operator which are not present in other lottery games wherein the winning numbers in a game are undetermined until availability of tickets for sale in that game has been terminated. In the latter type of lottery before a winning number is determined, all unsold tickets can be returned to the game operator or cancelled by the selling agents; a record of all sold and unsold tickets can be prepared and compared with records of original ticket distributions to selling agents; money from sales can be collected and accounted for in terms of the number and value of tickets sold. When a winning ticket is presented, it can be unhurriedly checked for authenticity and any fraudulent alteration of tickets or duplication which could result in multiple requests for payment of a prize is easily detected. For these reasons, government-operated lotteries in this country have employed the type of lottery in which the drawing of the winners takes place after all of the tickets are sold.

On the other hand, in the instant lottery contest, winning tickets may be presented for payment while the game is current. Additional tickets for the same lottery game remain on sale and continue to be sold. Should a well-counterfeited or altered ticket of the prior art type bearing a winning lottery number be presented for payment it is virtually impossible (without accounting for all sold and unsold tickets by discontinuing further sales in the same lottery contest) to determine whether or not the presented ticket had actually been delivered to the bearer upon valid sale by an authorized lottery ticket selling agent. The authentic ticket bearing the same winning lottery number may be unsold in the possession of the sales agent with the number still concealed, or the authentic ticket may be legitimately in the possession of another purchaser at the time when the falsified ticket is presented for payment.

Where there are prizes in smaller denominations of value (as is frequently the arrangement in widely promoted state lotteries) the ticket selling agent may often be authorized to make instant payment to a person presenting a ticket bearing a winning number, though the selling agent in this situation has little protection against fraud. In addition to the problems of fraud perpetrated on the game operator by customers there are several other very serious drawbacks in the present mode of operating instant lotteries. The expense of preparing tickets is high and the dangers of fraud by employees of the game operator who prepare the tickets are also significant.

Tickets for instant lotteries are now fabricated in various ways: One method uses a continuous printing press with sequencers to change the game numbers and serial numbers printed on the tickets. The sequencers advance for each ticket which passes through the press. Although the game number and serial number on a ticket are not permitted to be the same, there exists a simple relationship between the serial number and the game number by virtue of the sequencers advancing one digit for each ticket printed. After the tickets have been printed, the game number is concealed and ticket order is shuffled. However, it is a relatively simple matter for a person to determine the correlation between the serial number and the game number.

In an instant lottery this can be detrimental to the system security in that the serial number is generally used by the game operator to record ticket allocations among his sales agents. Any person or combinations of persons knowledgeable of the ticket-distribution channels and able to decipher the simple correlation between serial numbers and winning numbers can easily locate the sales agent possessing the winning tickets. Thus, in collusion with the sales agent, fraud on the game operator and the public is possible. Also an open purchase from the sales agent of his entire ticket allotment would be effective when a winning number entitled to a large prize award is calculated to be within the ticket allotment. Moreover, players, after purchasing several tickets, would be able to determine the fixed relationship between visible serial numbers and concealed lottery numbers and avoid additional purchase of "losing" tickets. Further, the counterfeiting of a winning lottery ticket, including the proper serial number, would be made possible when, as in the case of the instant lottery, the winning number is already known and the relationship to the serial number is easily decipherable.

Another method of printing lottery tickets employs a sheet press. In this technique, engraved plates for printing are prepared; a plate may contain 200 tickets, each with a different lottery number, but with some simple sequence to the numbers. The fabrication would be performed in batches, say of 50 plates to prepare for 10,000 tickets, and a hundred such batches are needed for a million-ticket game. After a sheet containing a plurality of tickets is printed, the sheet is sliced into the individual tickets. These sliced tickets are then stacked and shuffled to ensure that the lottery numbers on the tickets are not in consecutive order. Tickets bearing winning numbers are interspersed at the will of the game operator among the entire batch of tickets so there is a wide and preferred distribution of winners. Then the shuffled stacks of tickets, including the winning tickets, are fed manually into a serializer so that a consecutive serial number is imprinted on each ticket for the game operators' record-keeping and accounting purposes. Concealment of the lottery number is provided at any step in the process suited to the method chosen for concealment. In this way, stacks of tickets visibly numbered consecutively but having a scrambled arrangement of concealed lottery numbers are provided. Although the lottery numbers are concealed prior to the final stacking process, there are many manual steps in the procedure and ample time for the unscrupulous to identify the destination and the quantitative distribution of winning tickets. Additionally, the fabrication process provides opportunities for careless errors, as in printing duplicate sheets of lottery tickets from a single plate or failing to print a plate of tickets.

SUMMARY OF THE INVENTION

An object of this invention is to provide a new and improved construction for an instant lottery ticket.

Another object is to provide a new and improved instant lottery ticket having a high level of security against counterfeiting and fraudulent alteration.

Another object is to provide a new and improved instant lottery ticket that is inexpensive to manufacture.

In one embodiment of this invention, both the serial number and the lottery number are placed on the tickets by means of computer-controlled high-speed printers followed by the covering of the lottery number to hide it from view. This provides for extremely rapid and economical manufacture of tickets. Serial numbers are imprinted to indicate a game number, ticket lot and ticket number in consecutive order within the lot. The lottery number which is printed is determined by the computer and is interrelated with the serial number by a highly complex security algorithm. The computer process assures that no lottery numbers occur in duplicate or are omitted entirely from the completed batch of game tickets.

The lottery numbers are concealed after printing; one suitable technique is by placing an opaque covering over that number. For example, a foil coating may be laminated over the numbers by the application of heat and pressure. Thus, the computer-controlled printer produces a continuous strip of tickets bearing a consecutive format of serial numbers and a seemingly random arrangement of lottery numbers which are related to the serial numbers by a complex relationship. There is no apparent relationship between the lottery number and the serial number which appear on the same ticket. There is no need to separate or shuffle the tickets after manufacture and tickets may be provided in continuous accordion-folded strips or in rolls.

When a player purchases a ticket, he removes the covering which hides the lottery number, for example, by rubbing with the eraser of a conventional pencil, wetting the coating or tearing off a tab, depending on the mode of concealment that is used. The process of exposing the indicia is irreversible.

BRIEF DESCRIPTION OF THE FIGURES

The above and other objects of this invention as well as the features thereof will be more readily understood from the following description when read together with the accompanying drawing in which.

Corresponding parts are identified by the same reference numbers throughout the drawings.

An instant lottery ticket 10 in one embodiment of this invention (FIGS. 1 and 2) has the price 12 printed on the ticket face 14 and in the central area of the ticket general instructions and other information 16 are printed which is associated with such lotteries, games and contests. Said information 16 may include the identity of the game operator or it may contain instructions for use of the ticket, or specify redemption procedures for winning tickets. The printed information 16 may show the final date for valid sale of the ticket 10. Whereas indication on the ticket of the selling price 12 and any of the abovementioned information 16 add utility to the lottery ticket 10 and enhance the buying public's understanding of the lottery process, these features as such are not parts of this invention.

Figure 1:
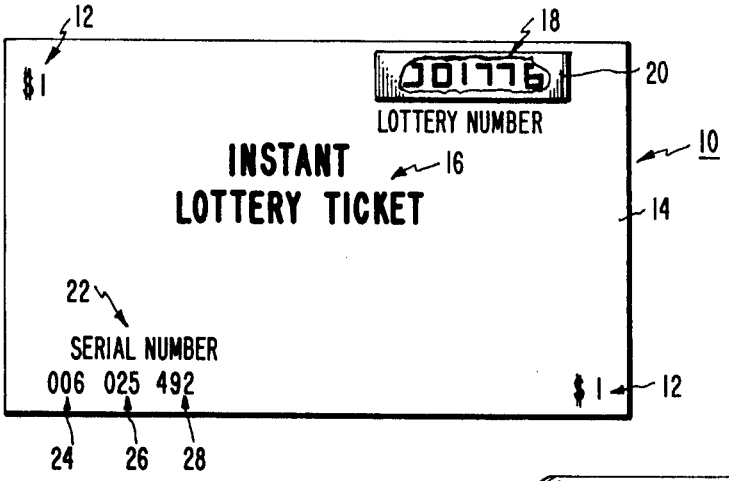
FIG. 1 is a plan view of the fact of an instant lottery ticket embodying the present invention with the lottery number revealed.

A lottery number 18 (using numerical or alphabetic characters or other indicia, e.g., letters, pictures, symbols) is presented on the face 14 of the ticket 10, which number 18 is obscured from view by a coating 20 or other device (shown in FIG. 1 as partially removed). The lottery number 18 is comprised of a plurality of digits (shown as 001776 in FIG. 1) and each lottery ticket in the same game or contest has a unique lottery number not duplicated on any other ticket. An individual serial number 22 used to keep a record of the ticket is also imprinted on its face.

The ticket 10 is constructed with the lottery number 18 concealed or otherwise presented in a format which disguises or makes unintelligible the true identity of the number. In the illustrated embodiment of this invention, the lottery number is concealed by a covering 20, applied with pressure, of opaque metal foil over the numbers. The covering may be in the form of a strip of foil that covers the entire area of the lottery number (as shown in the exploded view of FIG. 2) or in the form of separate sections covering each digit of the lottery number. Generally, the overlay 20 is larger than the area of the number being covered. Suitable forms of such coverings are known in the art. In actual use of the ticket, this foil coating 20 is quite thin and may be removed simply by a simple, readily available technique, such as by rubbing the surface with a rubber eraser as found on a common pencil or the edge of a coin. Moreover, it is not restorable once removed. The lottery ticket is printed on an opaque paper so that the lottery number is not visible through the paper from the back face. Alternatively, the back face is overprinted with an opaque ink covering to prevent seeing through.

The serial number 22 is composed of numerical characters (though it may also be composed of alphabetic characters or other indicia or combinations thereof) and is permanently printed on the face 14 of the lottery ticket 10 using conventional printing ink so that it is clearly visible at all times. The lottery ticket of FIG. 1 is illustrated with the serial number 22 consisting of 006 025 492. This number has little or no significance to the ticket purchaser; however, it may be formulated to contain information of value to the game operator and his selling agent. The serial number may be used by the game operator to permit a simple recording of the distribution of tickets from the operator to his selling agent and for an accounting of sold and unsold tickets. The serial number may also include an indicia or sequence number that identifies the particular game or contest for which this ticket is valid.

In the embodiment illustrated in FIG. 1, the group 24 consisting of number "006" is used to indicate, for example, that this ticket is valid in the sixth game in a series of separate games or contests. The central group 26 of the serial number 22, i.e., "025," is used by the game operator to indicate lots of tickets of known quantity. For example, there may be 200 lots each containing 500 tickets for a total of 100,000 tickets. The right-hand group 28 consisting of the number "492" is the unique number applied in consecutive order to each of the tickets in the lot. Thus, if there are 500 tickets in a lot, the last three digits 28 in the serial number 22 can have values from 000 to 499, inclusive. If there are a total of 200 lots of tickets to be distributed for sale in the contest, then the intermediate group 26 of numbers may have values from 000 to 199. The left-hand group 24 of numbers which identifies the game or contest for which the ticket is valid, may have values from 000 to 999 with the games being numbered by the game operator.

By maintaining records, preferably computerized, of the serial numbers of tickets distributed to each selling agent before sale and of those tickets returned unsold, the game operator maintains complete records and accountability for all tickets in each game. Also, if tickets are lost or stolen, it can be reported by serial number, and detection of any such tickets if presented for collection of prizes is simplified. Records of the serial numbers and ticket distribution also permit the game operator to know the whereabouts of unsold winning tickets.

In this invention, to assure the security of an aforesaid instant lottery game from counterfeiting or alteration of tickets a certain fixed correlation is established between the lottery number or indicia printed on each ticket and the serial number printed on the same ticket. A computer-controlled sequencer provides a serial number in accordance with the recordkeeping plan described above for each ticket in the order of printing. The correlation between the serial number and the lottery number is provided by use of a code or formula of sufficient complexity that it would not be readily identified from a comparison of the serial and lottery numbers of a reasonable number of tickets.

Figure 3:
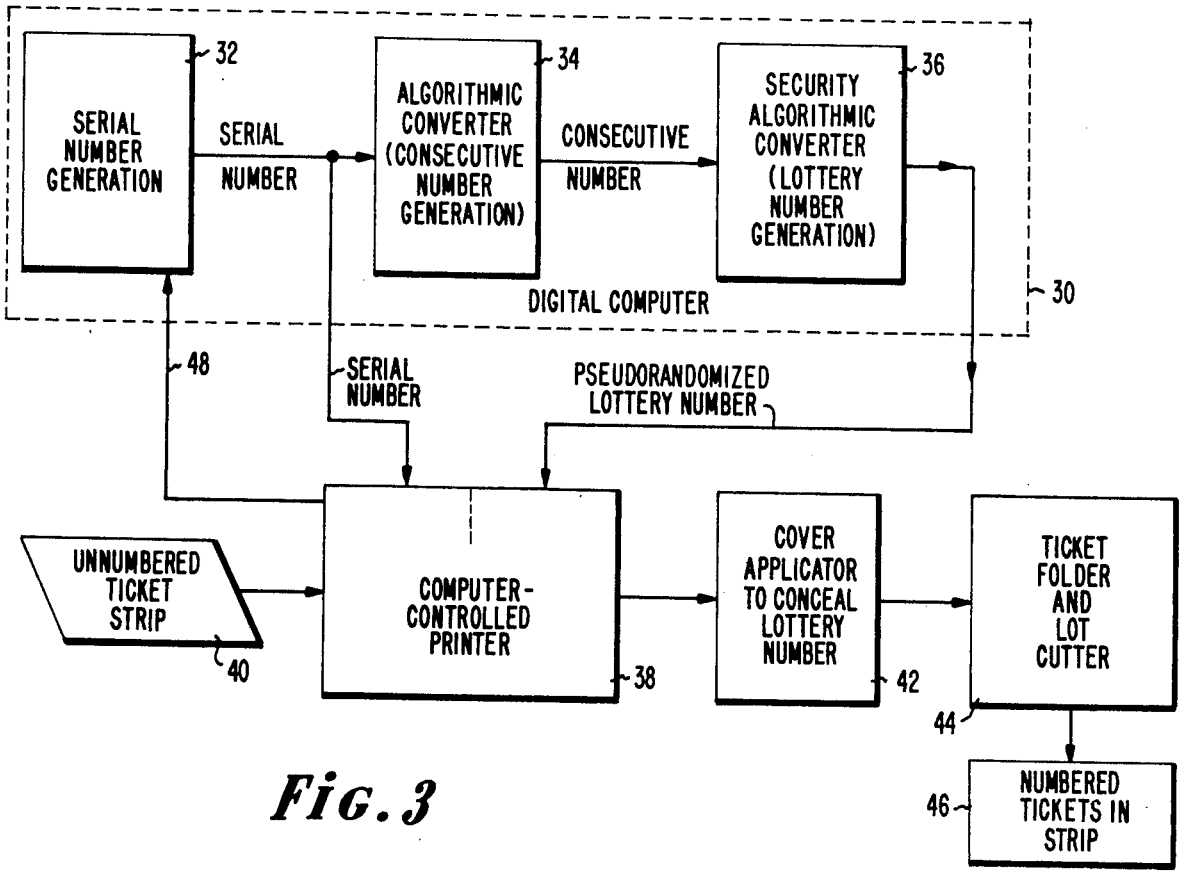
FIG. 3 is a flow diagram illustrating a method for manufacturing lottery tickets of this invention.

The method of fabricating instant lottery tickets in accordance with this invention is illustrated in the flow diagram of FIG. 3. To determine the lottery number which is to appear on a given lottery ticket a digital computer 30 is used. The latter includes a serial number generator 32 that generates the serial number 22 for each of a sequence of tickets in accordance with the recordkeeping plan which identifies game, lot and ticket. The serial numbers are transformed by a simple algorithmic converter 34 to intermediate numbers which are in a consecutive order for all tickets. (Where the serial numbers are already consecutive, rather than grouped as described above, the algorithmic step of converter 34 is omitted.) A second algorithmic converter 36 operates on said intermediate number, and generates the lottery number 18. Thus, as an example, a million consecutive (or partially consecutive) serial numbers 22 may be converted into a million seemingly random, nonconsecutive, nonduplicative lottery numbers.

A printer 38, which is computer-controlled (such as those which are used as peripherals to general-purpose digital computers) receives a continuous strip 40 of paper ticket stock, which is preprinted with all information other than the numbers 18 and 22, or which is to be completely printed by printer 38. Both the serial and lottery numbers 18 and 22 are printed on the ticket 10 which passes as part of a continuous strip 40 through the computer-controlled printer. The ticket is passed through a cover applicator 42, such as a foil press or a metallic powder applicator where the covering 20 which conceals the lottery number is applied. In a folder and cutter 44, tickets are automatically folded accordion-style and slit in sections and cut off from the strip in lengths 46 of suitable size, e.g., each containing a ticket lot. A signal on control line 48 from the printer advances the serial number generator 32 by one unit after each ticket printing operation is completed; the generator is programmed to recognize the ends of lots and other units where changes in sequence of the serial number are called for.

The special-purpose computer 30 and its portions 32, 34 and 36, is preferably constructed as a programmed general-purpose computer with each portion 32, 34, 36 corresponding to a separate routine or sub-program of the overall program though it may also be constructed entirely with digital circuitry. The programming has the advantage of being easily modifiable to meet the needs of different games and changing circumstances. The serial number generator 32 is stepped successively by signals on line 48 from the printer 38; a set of variable parameters controls the formation of the serial number and its subdivisions 24, 26, 28 in accordance with any desired arrangement. Converter 34 establishes the consecutive numbers which are the input to the security converter 36. The latter serves as a pseudorandomizer and may take the form, for example, of an algorithm having ten or more operators such as add or subtract a particular parameter, multiply by a number ending in 1, 3, 7 or 9 (i.e., not divisible by 2 or 5), shift a particular number of times or substitute groups of one or more digits in the serial number or in the subsequent number formed in some intermediate stage of the algorithm by access to a stored lock-up table. After each operation, the resulting number is truncated to the six least significant digits for the next operation. The parameter for each of these operators may be specified by a two-digit address to a look-up table in memory which would contain a hundred suitable parameters for each operator. Thus, the same form of algorithm could be maintained for a relatively long period of time, and its parameters readily changed from game to game. Only a very small number of persons would have access to this information. The particular algorithm and its parameters used for a certain game would be maintained under high security; even though such algorithms may be known to various persons as long as the specific parameters are kept secret, the security is maintained. For the algorithmic operations are sufficiently complex in the combination of a large number of specific logical manipulations that is required that there would be an extremely small (essentially negligible) probability that the specific correlation between the serial and lottery numbers could be determined from a comparison of the serial and lottery numbers of some practical fraction of the tickets. The cost of purchasing or otherwise obtaining a sufficiently large number of lottery tickets to obtain the serial and lottery number pairs so as to decipher the algorithm would be prohibitively expensive, and such deciphering would at best apply to one lottery or series using one specific set of operators, and would not apply to a succeeding lottery for which a different set of operators were used.

In general, all of these operations are of a class for converting one source set of, say, a million different numbers to a second derivative set of a million different numbers, each derivative number uniquely related to a number of the first set of numbers. For example, an operation such as adding a specified number to each of the million serialized numbers 000,000 to 999,999 of a first source set, results in a second derived set of a million numbers, wherein each derived number is different from its source number and yet the same as one of the other original serialized numbers of the first source set, with any seventh and higher place digit dropped. The transformations produced by each operator are within the closed pool of numbers of the first set operating in an arithmetic of modulus one million, so that in effect each operation produces a certain permutation or recycling of the original set of numbers. The output set of numbers of each operation becomes the input set of the next operation, and so on for each operation. Each such operation tends to produce its own randomizing effect by relocating the derivative numbers in different ways and to different extents from the original source serial number, while the serial numbers are maintained in their sequential order as printed on final strip 40. The cumulative effect of many such operations produces a considerable randomization of the final derivative numbers, namely the lottery numbers, as they are printed in the final strip 46 paired with the source serial number. Thus, in the final strip 46, the serial numbers are sequential (at least within lots) and the lottery numbers are effectively "shuffled" and appear to be substantially random. However, no mechanical manipulation of the tickets is required to achieve the randomized condition, as in other methods of making and packaging lottery tickets, described above, where the lottery numbers are first printed, the tickets are physically shuffled, and then the serial numbers are printed. Moreover, though "shuffled," the correlation between pairs of serial and lottery numbers is invariable within a game and can be used, as explained below, for security purposes.

In a closed pool lottery system where every ticket issued is generally sold, the exact number of winners (e.g., numbers that are five-of-a-kind) is known in advance, but the distribution of winners must be uniform. For example, in one million lottery numbers (from 000,000 to 999,999), there would be 54 lottery numbers for each five-of-a-kind (each of the 6 digits of the number in addition to five of any digit, may contain any of the 9 other decimal digits). It would be undesirable for the first hundred thousand tickets to have 20 winners and the last hundred thousand tickets to have, say, 2 winners. Therefore, the randomizing system must not only account for the number of winners but should also distribute them uniformly or otherwise acceptably among ticket lots. Secondly, in an instant lottery the smaller prizes are paid directly by agents (say, 2 free tickets). Therefore, each lot (e.g., 500 tickets) should have a uniform number of winners so that the agency operating the lottery knows in advance how many small prizes will be issued from each lot; and so that the public feels it has an equal chance of winning from each lot. In devising the prize structure for instant lotteries, control of higher level prizes is necessary. Thus, in the above example of 54 five-of-a-kind winners per million tickets, the designer may wish to uniformly distribute more or less than the statistically normal quantity of winners which would entail duplicating or deleting certain ones of these lottery numbers.

Thus, within the closed pool of lottery numbers, by the very nature of the instant lottery, the winners are specified in advance. That is, the particular lottery numbers that are to win are identified; the quantity of winners of low-value prizes in each lot or pack of tickets is specified; for the higher value prizes specifications are set for a uniform distribution or at least for producing positions of tickets that would not produce a significant skew in the distribution and for achieving a particular "seeding" or placement of winners within the various lots; and, depending on the game or pattern of winners, certain lottery numbers may be deleted and replaced with others, which may be duplicate nonwinners or winners as required in a particular situation. Thus, the pseudorandomizer 36 is constructed so as to enable the sponsor of the lottery to specify in advance each of the winning lottery numbers and to ensure that each pack or lot of tickets contains its own suitable quantity of winners within the lots as required, and at the same time to maintain a consistent lottery number pattern whereby counterfeits can be detected, and to "shuffle" the tickets for randomization.

As noted above, the winners may be described, not only by the specific lottery number, but also by its pattern character; for example, by the criterion that the lottery number have five (or any other quantity) of digits of the same kind, or two pairs of digits or by certain other patterns of digits. Since the overall pool of lottery numbers is closed (e.g., one million numbers), and the quantity and sizes of prizes will often be set by other circumstances to be less than or more than a particular pattern of digits, some of the lottery numbers will have to be deleted or increased. In one instance, if six of a kind is to be given a special prize, but only five such prizes are available, five of the then possible such numbers in a closed set of a million are removed (e.g., all of those with even numbers). For these deleted numbers, duplicate non-winning lottery numbers are assigned to the serial numbers corresponding to those deleted lottery numbers to provide the printed number pair. The computer process compares each calculated lottery number with the list of numbers to be deleted set up in a table. When such a number occurs it is replaced by the corresponding non-winning number also set up in that table. Similarly, duplicates of the winning numbers can be added from such a table where desired.

For controlling the distribution, winning numbers are placed in a table, and specific operators are set up in the lookup table and used for defining the distribution to determine at what point in the serial-number sequence to insert them in place of the lottery numbers. That is, when the serial number specified in the look-up table occurs, the normally generated lottery number is replaced by the winning number associatively set up in the look-up table. As these winning numbers are otherwise randomly generated in the pseudorandomizer process, they are identified and replaced by non-winning numbers set up associatively in the table. The control of the winner distribution is used to modify the normal generation of lottery numbers by the pseudorandomizer 36. Counts of the winning numbers that are normally generated in the various lots of tickets are kept and compared with pre-set quantities established in the parameter look-up table that define the desired distribution of winners. When a count of randomly generated winners exceeds the pre-set quantity for the associated lot or group of lots, the excessive winners are replaced by non-winners from the look-up table. If the randomly-generated count is insufficient, winners from the look-up table replace non-winners to the extent necessary.

Thus, the pseudorandomizer 36 is constructed to perform (in addition to the randomizing) the distribution of the winners in the prescribed locations and to delete (or add if desired) specified lottery numbers. These operations are performed so that for each serial number there is only one lottery number. Similarly, for each lottery number there is only one serial number except a small number of duplicates can be provided in certain types of situations, such as those described above, and they are clearly identified in each case so that the security of the system is not impaired. In effect, the pseudorandomizer performs the process of "shuffling," "seeding" and controlling quantity and distribution of winning tickets, without physical manipulation of the tickets themselves as would otherwise be required, and maintains a high level security and inventory control at the same time.

In the instant lottery game embodying this invention, the winning lottery numbers are stored in the computer along with the related serial number. When a ticket bearing a winning lottery number has been purchased and the lottery number has been exposed by rubbing off the foil coating 20 with a pencil eraser or coin, the player presents the winning ticket to the game operator for payment of the prize. Prior to payment the lottery number is entered by the operator into the computer; the pseudorandomizer 36 operating on the lottery number in a reversal of the randomizer process to calculate lottery numbers, computes a serial number and compares it with the serial number on the presented ticket. If a matching number is found, the pseudorandomizer confirms the validity of the presented lottery ticket, and the computer generates an output indicating "yes." If the pseudorandomizer finds any inconsistency between the newly calculated serial number and the presented ticket, it will indicate by a computer output "no" to the game operator that the presented ticket is invalid. The above-described modifications in the basic pattern of lottery numbers by reason of deleted or added numbers produce a store of the changes, which store is also checked for validity by the pseudorandomizer algorithm. In addition to checking the validity of the ticket, the computer may be programmed to indicate whether a prize has previously been paid on the same ticket (i.e., detect a fraudulent ticket with an identical serial number) or whether the ticket has been previously reported as stolen, and such tickets would be flagged. This checking process is performed by the pseudorandomizer 36 using the same operators as those employed in the printing process but operating in reverse order to establish the corresponding consecutive intermediate number. The latter, in turn, is converted to the serial number by converter 34 also operating reversely.

For smaller prize awards which are to be paid immediately by a selling agent before presentation of the ticket to the game operator, a telephone call to the game operator's center pemits computer verification of the ticket's validity prior to payment. For maximum security in this type of verification, the selling agent reports both serial number and lottery number, but the computer reports back only that the ticket is valid or invalid as presented. If the ticket is invalid, the computer does not report whether ticket invalidity is based upon an erroneously read or fraudulent serial number or an erroneously read or fraudulent lottery number. The requirement for inputting both serial and lottery number and the computer's response indicating invalidity without stating the basis for invalidity minimizes the amount of information which a sales agent can obtain from the computer regarding unsold tickets in his possession.

The continuous unnumbered ticket strip 40, in a typical fabrication example, may be a series of connected sheets in an accordion-folded condition. Each sheet is suitably dimensioned for a plurality of tickets 10; in one example, a sheet 14 inches wide by 11 inches long. Each such sheet is guided lengthwise through the printer by conventional sprocket holes along the outer edges of the continuous strip, and connected along the wider sides by perforations on which fall the accordion folds. Each sheet is pre-printed in four columns of tickets along the width and divided by perforations in six rows of tickets along the length to form 24 tickets per sheet. Such ticket strips 40 are printed without numbering relatively inexpensively by a continuous web press using a single plate and performing the perforating, sprocket hole forming and folding as well. The serial and lottery printing is performed in printer 38. With 840 sheets, slightly more than 20,000 tickets are printed to form a unit. The latter is readily divided by slitting in cutter 44 along the columns into four strips of about 5,000 tickets. With each strip divided at the proper row perforation into 10 lots of 500 tickets each (plus 4 tickets that may be left unnumbered and unused and suitably voided). Thus, each ticket lot 46 may be in the form of a continuous strip of connected tickets. The printing of fifty such units produces a million tickets. The pseudorandomizer is constructed to print the serial numbers of each lot in sequential order and to randomize the lottery numbers within each lot. In the printing process, four such tickets in each row of strip 40 are printed simultaneously (e.g., by a line-at-a-time printer) and the serial numbers of these four tickets would correspond to four different lots of tickets. The digital computer can be operated at relatively high speed rates (e.g., in microsecond computations while the printing operations may require several milliseconds) so that all of the necessary computations of the serial and lottery number pairs can be determined including the modifications required for positioning winners to ensure that proper quantities and distribution of winners are developed with the printer connected on-line. Alternatively, the printer may be off-line and the computations all performed in advance. With this method of fabricating the lottery tickets, the pseudorandomizer 36 performs the randomizing "shuffling" of the lottery numbers as well as the selection of winning numbers and their uniform distribution and "seeding" in the proper quantities for different types of prizes. The lots 46 of tickets are unbroken strips of connected tickets with the lottery numbers randomized and correlated to the serial numbers for maintaining a high security and with the winning lottery numbers controlled and distributed for the other important features of an instant lottery.

A practical and economic process of printing the lottery tickets is also achieved concurrently with the high security of correlated pairs of lottery and serial numbers. Such computer printing may be achieved with a fraction (e.g., one-half) of the cost required for other techniques for fabricating instant lottery tickets. For example, in another form of instant lottery fabrication, the cost of composing and developing multiple printing plates that include the numbering operation for the lottery numbers, covering the lottery numbers, slicing the tickets, shuffling them mechanically, seeding the winners, printing serial numbers for inventory control and packaging and shipment can average more than one cent per ticket for quantities of 50 million tickets and more. This invention achieves substantial savings in the ticket fabrication cost.

Accordingly, the use of a computer-controlled printer 38 which may be on-line, or off-line, operating from a suitable store of serial and lottery number pairs that were previously generated) directed by pseudorandomizer 36 ensures a high level of security from counterfeiting and fraudulent alteration and from anyone being able to predict the pattern of lottery numbers within a lot or pack. The fabricating method of achieving this security is so devised that the director of the lottery can specify the winning numbers for the instant lottery, the quantities of winners for different prizes, can control the uniformity and accuracy of their distribution to esnure fairness and maintain interest, and has the flexibility of modifying the pattern of lottery numbers to meet the needs of various games. Moreover, the number of persons having access to the ultimate high security information (such as the security algorithm or the location of winners) can be as few as desired so that leaks and misuse of such information are minimized.

Various modifications of this invention may be made and will be apparent from the foregoing description which is presented by way of illustration of and not as a limitation on the scope of this invention. For example, in place of the foil coating 20 applied as an opaque covering for the lottery number 18, various other coverings may be used, such as the application of a metallic powder or a paper or metallic covering in a miltilayer ticket, that would have to be torn away to expose the lottery number.

In another embodiment, this concealment may be achieved with an invisible ink which is used for printing the lottery number 18 on the ticket surface 14. After sale of the ticket the lottery number 18 is exposed to view by application to the surface 14 of heat, moisture or a chemical agent as is suitable to transorm the ink which has been selected for printing of the lottery number. Suitable examples of invisible printing inks which may be transformed by introduction of an external stimulus are known in the art. Other techniques to disguise the lottery number may include inks which change color or disappear under the influence of an external stimulus so as to modify the originally presented indicia. The disguise and concealment process may require a plurality of passes through a computer printer. Where inks are used, the use of an impact printer generally would not be suitable, for the mechanical impression would be detectable even though the ink would not; other types of computer-controller printers would be suitable.

This invention may be used for various games of chance of the instant type where one exposes a covered, or otherwise hidden game indicia to determine the nature or value of a prize. Such games may be governmental lotteries or games of chance sponsored by charities, fraternal organizations or public service groups, or by commercial establishments. Such games may also be in combination with other contests such as by combining an instant lottery and bingo by imprinting the hidden chance indicia on bingo cards. Playing cards for a game may be based on a variety of printed devices customarily used in commercial activity. For example, sales slips in department stores, register receipts, and commercial coupons and other give-away tickets from newspapers and magazines and mailers (such as those used for sales promotion, discounts, rebates and merchandising) may be constructed in a manner similar to that described above. That is, a serial and lottery number pair is printed on each printed device, and the lottery number covered, as described above, to form the playing cards for a game. Such playing cards may be used as instant lottery tickets as described above or as some variant thereof for the receipt of a prize granted to pre-set winners, whether some purchase is made or not. The number pairs may be in the form of any suitable indicia appropriate to the game and sales promotion and merchandising activity. The term lottery ticket is used herein to cover all such cards for playing games of chance wherein a prize is awarded for a card having a certain winning lottery number; "lottery number" is used herein for all numbers of chance including indicia in alphabetic, numeric or other symbolic form. The term lottery is used herein in the broadest sense of a game or other arrangement for distributing prizes by lot or chance and is not limited to those games for which one purchases a ticket to participate, and would include the aforementioned examples of games using sales slips, register receipts and other commercial promotion devices for which it is not necessary to pay for the playing card.

The special advantages of this invention in the use of computer-controlled printing are applicable in each of the above embodiments. For example, in the fabrication of sets of sales slips, which may be conventional in most respects, the addition of a hidden lottery number generated by computer from the serial number in the manner described above is effective to produce a ticket construction for a game of chance (e.g., lottery) that incorporates features of this invention. Such sales slips are conventionally formed in strings of connected slips and are stored in a dispenser or book for filling out and detachment. The customer's copy would be the one that would be constructed as the lottery ticket. Though connected in a string, these sales slips may have the lottery numbers pseudorandomized and the winners distributed in the manner described above, so that they may also be used in a lottery or game of chance in connection with a sales promotion. Similarly, the roll of cash register receipt paper may be pre-printed in successive sections of suitable length with a serial number and a hidden lottery number in correlated relation. The receipt paper is used in a conventional fashion for its intended purpose, but also each receipt length with a hidden lottery number correlated to a serial number may also be used for a lottery ticket in a game of chance or lottery.

The invention may also be used in the fabrication of playing cards for instant games and novelty cards and for game boards of various types in which the generation of various patterns of game indicia (such as in parlor games) is performed by computer, and the latter is used for controlling the printing of the indicia, which are then covered or otherwise hidden to be exposed at an appropriate time in the use of the card or board. Such indicia (numeric or other symbols) are successively uncovered, for example, to simulate the progress of a competitive game or match such as football or other sports. Such cards and boards have the advantages of low cost fabrication and printing when fabricated in accordance with this invention, together with the advantages of computer use for generating different patterns of indicia of varied degrees of complexity so that the games may be constructed to maintain continuing interest.

In another embodiment of this invention (FIGS. 4–7), fan-folded paper sheets 50 (FIG. 4) are used for the computer printing of the game cards (e.g. instant lottery tickets 10) of this invention. The paper stock 52, 54 used in the manufacture of instant game cards such as lottery tickets has special characteristics relative to printability, abrasion resistance, bonding and fibre tear. Two types of paper are used in the construction of the card. One is for the front face 52 of the card and the other for the back 54. Because the game is played on the front of the card, the paper for the card face should: (1) permit high quality printing via a high-speed photo-offset web printing press; (2) be extremely abrasion resistant when scraped by the edge of a coin, key, fingernail or other object; (3) provide surface characteristics that permit a positive and permanent bond when laminated to the opaque barrier material 51 of the game card; (4) resist physical de-lamination from the opaque barrier by either heat, liquid solvents or other means; (5) tear at the fibre so as to destroy the physical integrity of the paper when de-lamination of the card is attempted. A nominal specification for the card face paper 52 would consist of 38 lb. lightly bleached Kraft, long fibre, 0.003" caliper, machined glazed. The paper for the back 54 of the game card should possess the same characteristics but need not be highly abrasive resistant. Typical specifications consist of 73# standard grade offset white, 0.0065" caliper, machine glazed.

In the lamination process 53 (FIG. 6) of the secure game card stock, an opaque barrier 51 is placed between the face paper 52 of the card and its back paper 54 which may be the same as, or different from, the face paper 52. The purpose of this opaque barrier 51 is to prevent "see through" in the final product. That is, in its final form, the printed game card has some data on its face 52 (FIG. 4) that is concealed from view until the card is purchased and the covering 20 (FIGS. 1 and 2) is scraped off. The opaque barrier 51 prevents "seeing through" the card with a high intensity light source so as to be able to discern the game data on the card without scraping off the covering 20. This prevents card sellers from picking out winning cards and selling losing cards to an unsuspecting card buyer. The opaque barrier 51 may be any suitable material that prevents "see through." Typical materials specifications are 2 mil photographic black polyethylene, or 0.0003" aluminum foil.

The face paper 52, the back paper 54 and the opaque barrier material 51 are laminated 53 to form a continuous sheet of paper stock, of average caliper of, for example, 0.010 inches ±0.001 inches. When aluminum foil is used as the opaque barrier 51, the face paper 52 is first bonded to the aluminum foil with permanent bonding agents. The two-ply laminate is then bonded to the back paper 54. When materials such as photographic black polyethylene are used as an opaque barrier, the front and back paper and the black polyethylene are extruded at high temperature to product the three-ply laminate. The 3-ply laminate paper stock is produced on master rolls that are slit to size for use on a web offset printing press. A typical dimension for a roll of laminated paper stock is: 14" in width; outside diamter of 40", and a 3" core with preferably not more than one splice per roll. The opaque barrier is substantially uniform with no voids, pin-holes or gaps and extends from edge to edge of the roll.

The laminated paper stock is shipped in these rolls to a continuous forms printer 55. Th card stock printing of the lottery tickets is done on a multi-section continuous web offset printing press so as to enable subsequent printing of the lottery or other game data by a high speed printer. The number of printing stations required depends on the number of colors required by the game card design. A typical requirement would be four colors on the face of the card and one color on the back. Thus, a five station web press would be required. Four colors on the face of the ticket permits printing of game cards with a full color process. Prior to the printing of the game cards, the specific game to be played is defined, a card layout is designed, and a theme for the game is selected. Once a game card has been designed, a mechanical is prepared, detailing the specific copy, dimensions, colors and screening, and this mechanical is utilized to produce printing plates via the photo-lithographic process for the continuous forms web offset.

Figure 4:
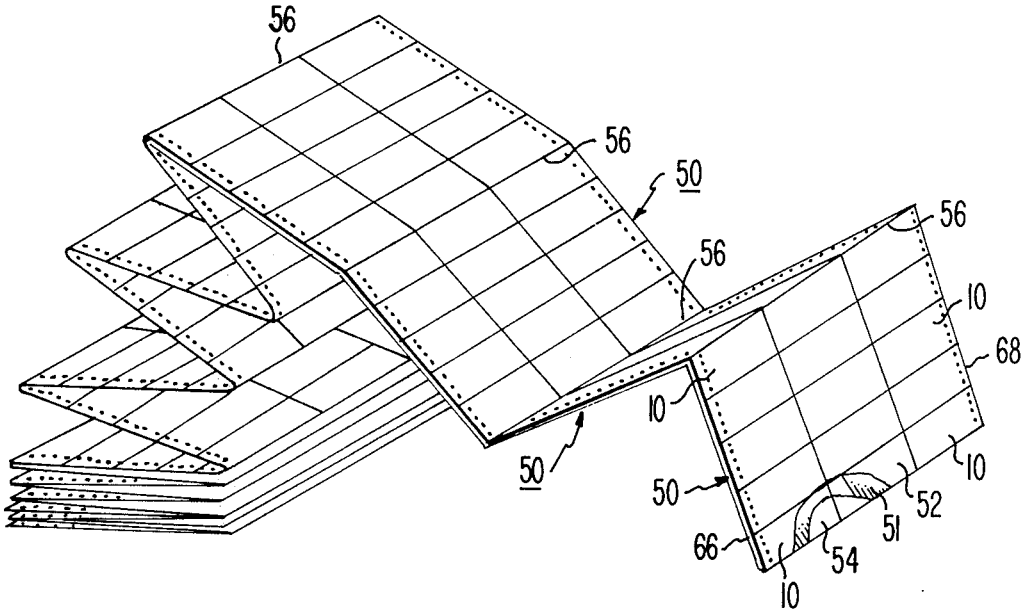
FIG. 4 is a perspective view of several sheets of fan-fold of computer-printed lottery tickets embodying this invention.
Figure 6:
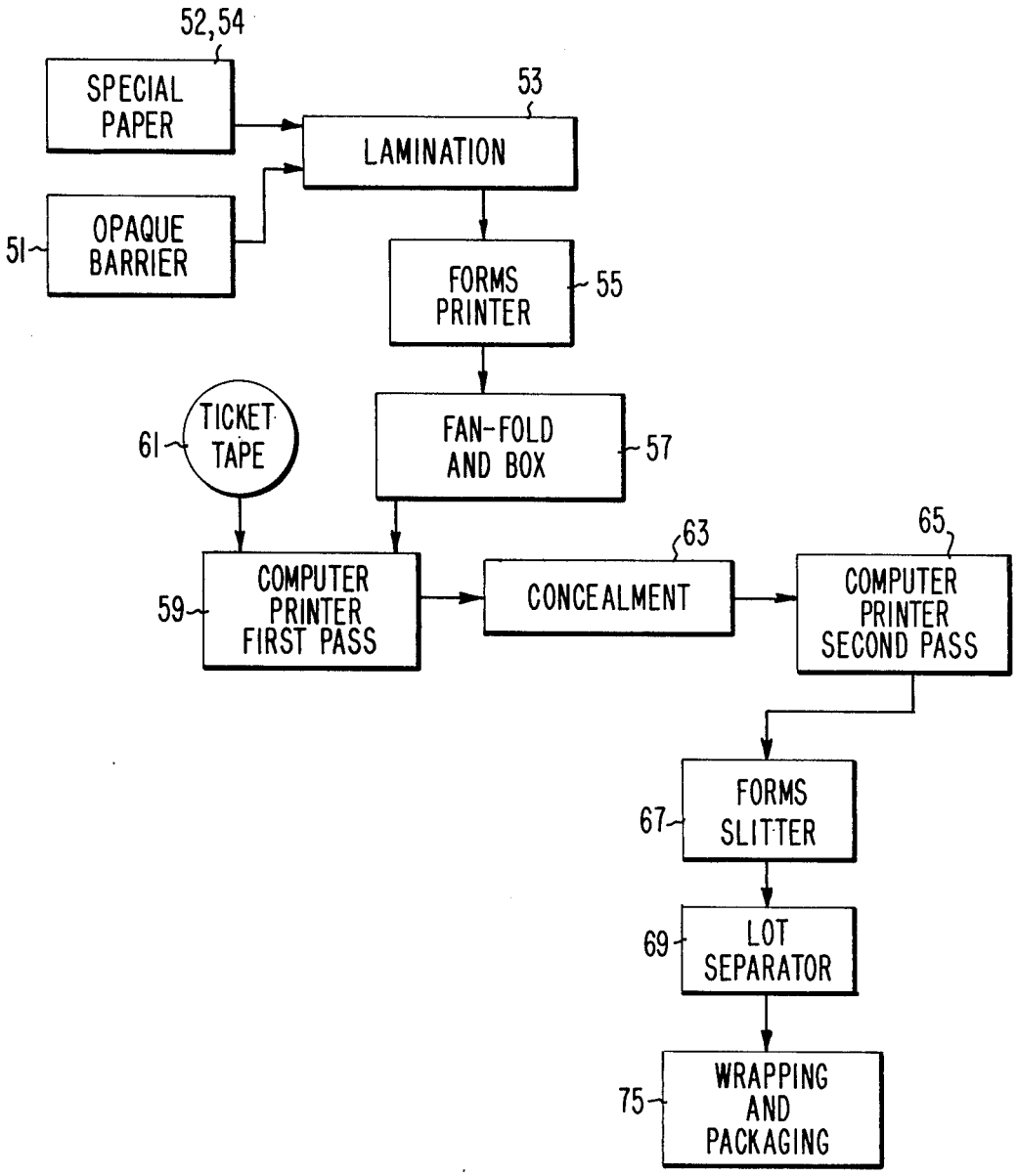
FIG. 6 is a schematic flow diagram illustrating another embodiment of the method for manufacturing lottery tickets of this invenion.
Figure 7:
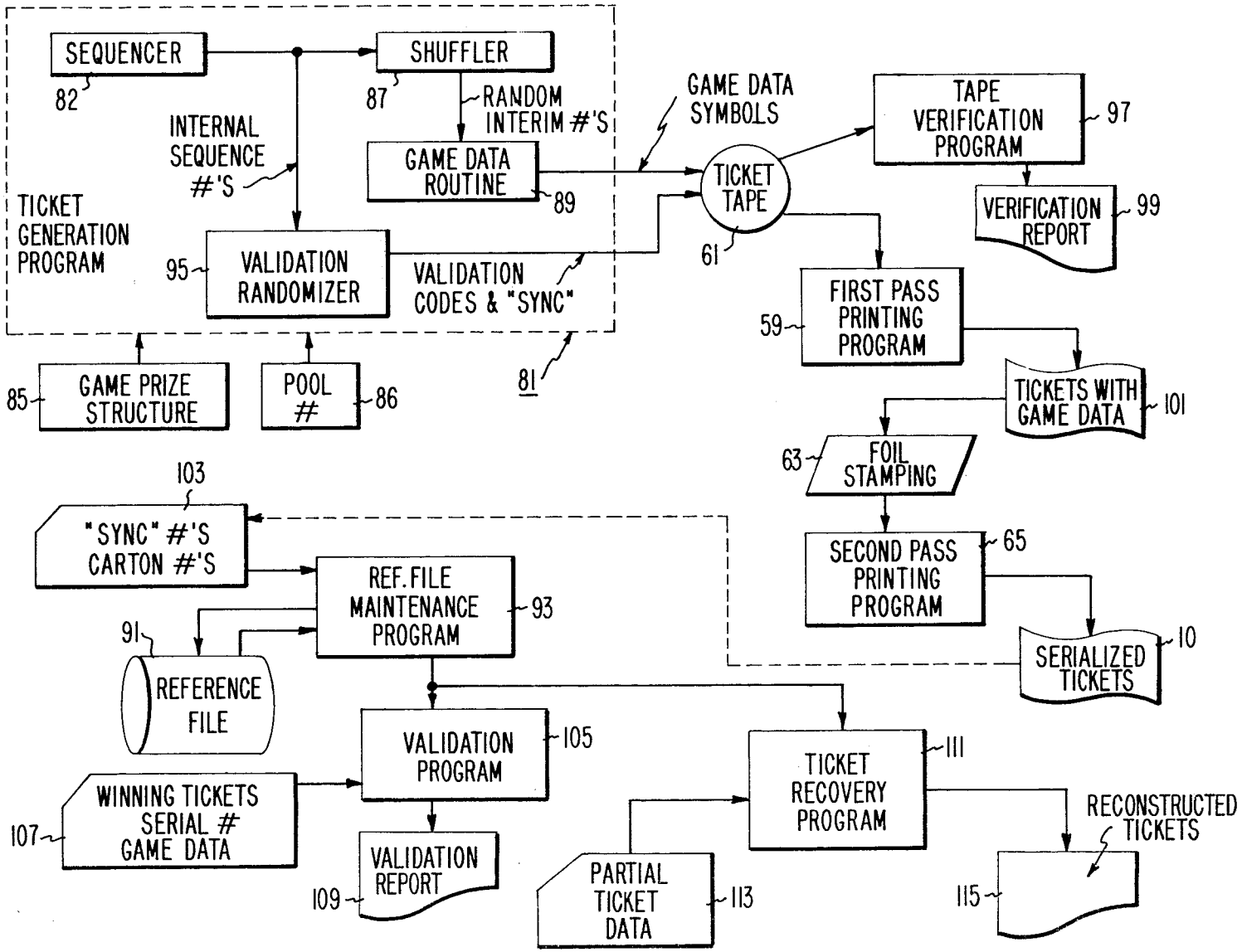
FIG. 7 is a schematic flow diagram of the computer control used in the manufacturing method of FIG. 6.

At the output end of the web press, the continuous sheet of printed stock is perforated to a specific forms depth (usually 11") to permit fan-folding 57 of sheets of multiple game cards, with margin pin holes 66, 68 for use in a computer printer (FIG. 4). Each sheet 50 contains from 15 to 24 game cards 10 on a nominal sheet size of 14" wide by 11" deep (i.e. 3 columns by 5 rows of tickets, or 4 by 6). An illustration of a segment of continuous sheets 50 connected in a string along perforated edges 56 in fan-folded form is shown in FIG. 4. The fan-folding of the sheets 50 permits a specified number of sheets to be boxed for shipment while maintaining them in a continuous condition for subsequent computer printing. Typically the number of game card sheets 50 may range from 750 to 1,000 sheets per carton, depending on the individual game card size.

The boxed sheets 50 of multiple game cards, which do not yet contain the game data, are then constructed in final form in the next part of the manufacturing process and thereafter packaged for shipment to the user. The first step in this part of the manufacturing process is to print the game data (which is preferably generated off-line on magnetic tapes 61) in a computer printer 59 on the continuous fan-folded card sheets 50. The generation of these magnetic tapes 61 is discussed in detail below.

The configuration of a computer printer 59 is a modified one so that the printed game cards 10 are made unique, as follows:

(a) a special print train is utilized with non-standard print slugs so as to produce a game card 10 with a unique non-reproducible type font for the game data; and (b) special computer inking ribbons are used to produce a non-eraseable printed character.

Upon completion of the first-pass computer printing 59 of the game data, the sheets 50 of tickets are reassembled in their cartons. Next the sheets 50 of multiple game cards, still in continuous fan-folded form, are processed through a foil leaf stamping operation 63. On the foil stamping equipment is mounted a stamping die that is an exact replica of an individual multiple game card sheet 50. The stamping die is machined so that only areas 18 on each game card 10 to be concealed come in contact with the die. The stamping equipment also employs foil leaf in 14-inch wide rolls. The foil leaf can be either hot stamping foil (one requiring a heated die during the stamping process) or one that stamps at ambient temperatures.

During the foil stamping process, the multi-game card continuous sheets 50 automatically are pulled through the stamper one at a time. The foil leaf is threaded through the machine so that it passes between the game card sheets and the stamping die. Thereby, overlay sections 20 are cut out of the foil leaf and bonded to the cards 10 at the game data 18 to conceal it. Once a multi-game card sheet 50 is stamped with the overlays 20 on each card, a new sheet 50 is moved into place, the foil leaf is advanced and the next sheet 50 of game cards is stamped. This process is repeated automatically at stamping speeds ranging from 2,000 to 4,000 impressions per hour. Between the first and second computer process, the ticket cartons are manually reordered in a random fashion for security purposes as explained below.

Second-pass computer printing 65 is done with the off-line high speed computer printers utilizing the control data that has been recorded on the magnetic print tapes 61. Special inking ribbons are again used for anti-tampering purposes. The information that is computer printed on the game cards during the second pass is the equivalent of a unique serial number 22 for each game card; it serves as an Inventory Serial Number. This numbering scheme consists of alpha-numeric characters that define the series, the lot (or pack) number, ticket sequence (individual ticket) number, and code and control number designators. For example, the 130th ticket in pack number 4001 of Series L would be printed on the game card as:

| Series | Lot | Sequence |
|---|---|---|
| L | -4001 | -129 |

The 130th ticket shows a sequence number of 129 because the numbering scheme starts with 000 for the first game card. This scheme permits rapid documentation of the number of game cards sold; the selling agents merely record the sequence number of the first unsold ticket in the lot, which sequence number gives the number of the game cards sold. In the above example, if the card number 129 is the first unsold card, by recording that sequence number the agent records the actual number of cards sold (129).

Through the above numbering scheme, game card Inventory Serial Numbers are computer printed from card images on magnetic tape. No cards can be missing from a lot (or pack) since cards are printed in continuous form and are connected in the pack and all initial cards are checked to see that the first card starts with sequence number 000. The card Inventory Serial Number also serves as a distribution control number as well as the means by which winning cards are validated prior to prize payment. The lot (or pack) number of each lot of game cards is recorded prior to distribution of cards to distribution centers and then to selling agents. Again, the number scheme permits control of any number of lots by simple and quick single line entries on shipping documents. For instance, if 5,000 lots are to be distributed to distribution center A, the shipment would be recorded as:

| FROM | TO | TOTAL LOTS |
|---|---|---|
| L-0000 | L-4999 | 5,000 |

The same technique is used to record lots distributed to selling agents.

Figure 5:
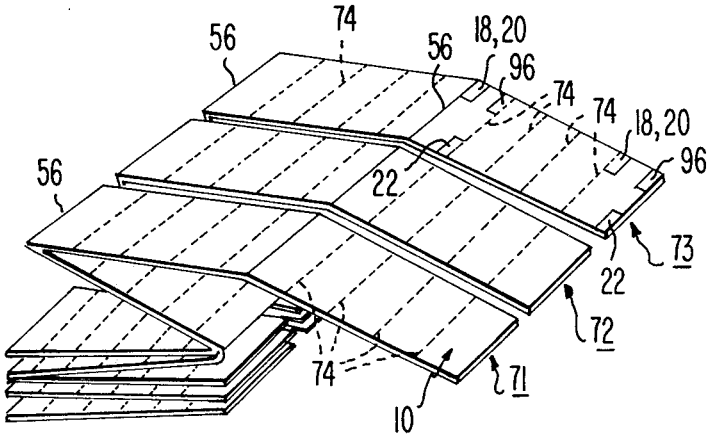
FIG. 5 is a perspective view of three strings of game cards separated from the sheet of FIG. 4 after complete fabrication.

Upon completion of the second pass computer printing of Inventory Serial Numbers, the game cards, still in continuous, fan-folded sheets, are fed into a forms-slitting equipment 67 that simultaneously slits the game cards into separate batches (but still in continuous strings) and strips the left and right pin feed margins 66, 68 (FIG. 4). FIG. 5 shows the game cards in continuous strings 71, 72, 73 after this slitting operation. The slit batches of game cards contain multiple lots (or packs) of game cards that can vary in quantity, depending on the size of the specific cards. Typically, there are 500 game cards in each lot and 10 lots in each continuous string of game cards.

The next operation in the fabrication procedure is to detach 69 the multiple lots in each continuous string of game cards into each individual lot (or pack) of 500 cards. This operation can be done manually by separating the lots along the perforation fold 56 between the last card in the previous lot and the first card in the next lot. For a 500-card lot, this would be between cards bearing sequence number 499 and 000. The game cards 10 in each fan-fold strip between successive perforations 56 are connected along perforated lines 74. The construction method of this invention also allows for the slitting and detaching operations to be combined in one operation, through the use of an automatic slitter detacher. This equipment slits the sheets of game cards into separate batches, counts the number of cards slit, and then automatically cuts the continuous string of cards into lots of 500.

Game cards are packaged in individual lots of cards that are shrink wrapped 75 with a polyethylene film. The individual lots are packed into shipping cartons containing 10,000 to 20,000 game cards to each carton. The lot numbers of each lot are recorded on the outside label of each shipping carton for reliable distribution. The final process of the method is to palletize the shipping cartons for shipment. The palletization method is designed to enable viewing and inspection of all cartons without removing or handling any of the cartons. This is accomplished by arranging the cartons with labels and with no hidden cartons.

Figure 2:
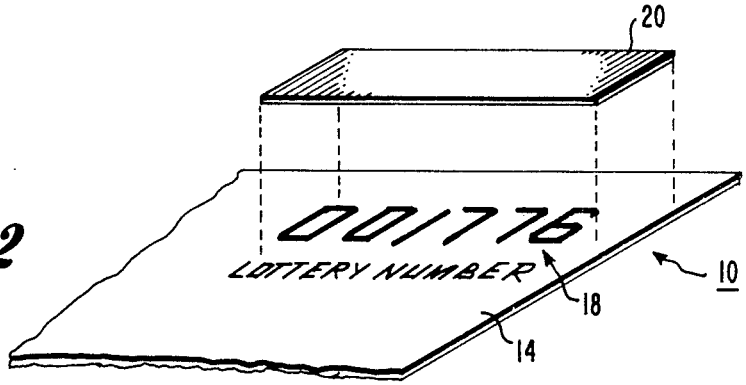
FIG. 2 is an exploded isometric view of a portion of an instant lottery ticket of this invention illustrating the relation of the coating and the lottery number.

The computer control portion (FIG. 7) of the manufacturing method (FIG. 6) is constructed as follows: A ticket generation program 81 is used to generate the data for all of the tickets and to store the data on magnetic tape 61 for off-line operation of the computer printer 59. That is, stored on the tape 61 is a set of data used ultimately in the first-pass printing program 59 for printing the game data 18 (FIG. 1) and an individual validation number 96 (FIG. 5) on each ticket 10. The validation number, in some embodiments, appears on the face of the ticket and serves as additional security; however, as shown in FIGS. 1 and 2, this validation number is not required and not used for some embodiments.

The tape generation program includes a sequencer 82 and a shuffler 87, which successively receives the internal sequence numbers created by the sequencer 82, and from them generates a set of random interim numbers on a one-to-one basis. The latter numbers, in turn, are supplied to a game data routine 89, which performs a transformation of the interim numbers into game data symbols which may be numbers or any other symbols used in the particular game. In addition, the game data routine performs a "seeding" function to ensure that the correct number of winners at each level is provided in accordance with the game prize structure 85 that is supplied as a set of data or constants for the program 81. For all of the specified random interim numbers that are associated with winners, the prescribed winning combinations of game data symbols are inserted. Thus the output of the game data routine 89 is stored on the ticket tape 61 and consists of signals for the lottery numbers or game data symbols 18 (FIG. 1) which are to be printed and covered by the concealment material 20 (FIG. 2). Also supplied as input to the ticket generation program are a particular set of constants known as the pool numbers 86, which determine the parameters for that particular pool which are used in the randomizer of the shuffler 87. In some embodiments of this invention, a validation code randomizer 95 is used to generate a unique validation number 96 which is printed on each ticket 10 (FIG. 1), in addition to the Inventory Serial Number 22 and the game data 18.

The pool numbers 86 also affect the parameters used in this randomizer (which may be similar to the shuffler randomizer or may be of a different type). This validation-code randomizer 95 also receives the internal sequence numbers and generates the corresponding validation codes 96.

A tape verification program 97 checks the contents of the ticket tape 61 to determine whether the number of winners at each level corresponds to the game prize structure 85 to ensure that no errors were created, and it generates a verification report 99 accordingly.

The first pass printing program uses, preferably, an off-line printer 59, which operates with the precomputed data recorded on the magnetic tape 61. This mode of operation is far more efficient than on-line printing, since the printing operation is substantially slower than the generation of ticket data for the magnetic tape. This first pass printing program 59 sets up the symbols to be printed on the entire sheet 50 (FIG. 4) of tickets at one time, and includes the printing of the game data or lottery number 18, together with the validation number 96 (when the latter is included in the system). The tickets 10 are partially printed in this first pass 59; the Inventory Serial Numbers are printed in the second pass 65.

Also generated in the first pass printing program 59 by a randomizer (for example, by the validation code randomizer 95) is a control code or "sync" number 103 associated with each carton of sheets of tickets. This code number permits controls to be maintained for each carton of tickets without those working on the computer or foil stamping process being able to associate winning numbers with the serial numbers ultimately imprinted on the tickets.

After the first pass printing program 59 the foil 20 is applied to conceal the game data 18 in the manner described above. After the foil stamping 63, the cartons for all of the tickets are physically and randomly rearranged, and then, on an arbitrary basis, the cartons are handled sequentially in the second computer printing pass to print the Inventory Serial Number 22 on each ticket successively, without regard to the sequence in which the tickets were handled in the first pass. This is the final imprinting. After this second pass, the "sync" number (computed in the first pass) is set up in a reference file to be used thereafter in the validation operation.

The validation program 105 directs the computer to determine whether or not a proferred ticket is a winner 107, and, if so, of what prize. It makes use of the shuffler randomizer 87 described above, and it receives as inputs both the Inventory Serial Number and the game data of the ticket being presented for validation. Also supplied to the validation program 105 is the internal sequence number used as the input to the shuffling randomizer 87. This number is derived by using the Inventory Serial Number to obtain the carton number, which serial and carton numbers have a fixed relation since there is a uniform number of tickets in each carton. Making use of the carton number, the reference file 91 supplies the corresponding "sync" number, and this number is transformed by a reference-file maintenance program 93 to the internal sequence number. The latter program uses the inverse randomizer (e.g., the validation code randomizer 95) that was used to generate the "sync" number in the ticket generation program 81. With the internal sequence number, the validation program 105 is able to proceed to reproduce the process performed by the ticket generation program 81 and confirm that the game data 18 for the given Inventory Serial Number on the asserted winning ticket is valid. The output is a validation report 109 indicating whether or not the combination is a valid one, consistent with the system as established. A ticket recovery program 111 generates reconstructed tickets 115 from data read from partially mutilate tickets 113, as explained below.

In operation, during the first pass through the computer printer 59, the randomized game data (i.e., variable information to be printed on the lottery tickets which determines whether the ticket is a winner and of what prize), is printed on the continuously connected sheets 50 of game cards 10 for each carton of fan-folded sheets 50 (FIG. 4). Since the Inventory Serial Numbers are not yet printed, an operator who identifies winning combinations of the game data 18 before it is concealed, does not also have the Inventory Serial Number, and therefore is unable to track a winning card through the seller.

The game data is generated by the ticket generation program 81 in pools of either 100,000 or 1,000,000 tickets, each pool containing exactly the number of winners as prescribed by the prize structure 85. The winners are distributed randomly among all tickets in the pool, each pool having a different distribution of winners. The numbers shuffling algorithm 87 generates random interim numbers that are converted by a game data routine 89 to game data symbols in accordance with the game structure and to "seed" winners in accordance with the prize structure. This construction is used to make the game data random (within the prescribed rules) for winning as well as losing tickets. The fact that two independent algorithms 87 and 89 are respectively used for randomizing and for generating game data and distributing winners eliminates any correlation between the position of the tickets and the game data on the tickets.

In some systems a third algorithm, a validation code randomizer 95 is used to generate a unique validation number for every ticket. The validation numbers are stored on the tape 61 with the game data and are subsequently printed on the tickets. In addition this randomizer 95 is used to generate "sync" numbers (control codes) for each carton of fan-folded sheets which numbers provide high security entry points for the validation program 105. The game data is written on the magnetic tapes 61 in a concise binary form, sometimes scrambled for additional security. One tape contains anywhere from 200,000 to 1,000,000 tickets, depending on the game design and the amount of information needed for each ticket. The tape verification program 97 directs the computer to check the ticket tapes 61 containing game data. In this process, the tape is scanned sequentially, the ticket data examined and verified to see if it conforms to the syntax rules of the prize structure 85; counts of winning tickets in each category are compiled and verified to determine whether or not they agree with the planned prize structure. This control program then causes a verification report 99 to be printed, which report is then checked by the operator to verify that the tape 61 is in condition for controlling the printing of the game data. There are no serial numbers assigned to tickets on tape 61; every ticket may be identified by the sequence in which its game data was generated, starting from an initial internal sequence number for that particular tape, which is generated from some suitable by sequencer 82 as needed.

In the first computer pass 59, the tapes 61 provide the data for individualized printing of the game data (lottery numbers 18, FIG. 2) on the associated ticket, to produce the first pass tickets 101. These may also have the validation codes 96 (FIG. 5). In addition to the printing of game data on each first pass ticket 101, the first computer pass prints the "sync" codes on one sheet 50 of each carton of fan-folded tickets (FIG. 4); these numbers allow the correct identification of each carton. This coding is in the form of another random number which uniquely identifies either the carton or a particular pack of tickets in that carton.

As discussed above, after the first computer pass the instant lottery tickets go through a foil stamping process 63. During the second computer pass 65 the unique Inventory Serial Numbers 22 are printed sequentially on all tickets (starting from some suitable initial number consistent with inventory control function) and, using a sequencer such as the sequencer 82, the modified numerical sequence of the Inventory Serial Number is generated, to produce the fully printed tickets 10. With three strips 71, 72, 73 of tickets, the computer may be used to print three different sequences of serial numbers concurrently.

Since ticket cartons are rearranged for security purposes between the first and the second print pass, the relationship between each ticket's game data 18 is lost. However, this relationship must be restored to enable the ticket validation program 105 to operate. The relation between the first pass carton number and the second pass carton number is maintained in the reference file 91. The reference file maintenance program 93 is used to control the creation, updating and maintenance of this file. One of the following may be used as input into the maintenance program to identify the first pass carton number: a carton code off the leader sheet, a pack code off a voided ticket a validation code from a ticket in the carton, The validation program 105 directs the computer to determine whether the proferred ticket 107 is a winning ticket and what the prize is. The Inventory Serial Number is read from the ticket. The carton number is then determined from the Inventory Serial Number (since the latter are printed on the tickets sequentially and the number of tickets per carton is known). The "sync" number for that carton is then located in the reference file 91, and the "sync" number, in turn, serves as the entry to the inverse validation randomizer 95, which can be used as part of the maintenance program 93. The latter generates the corresponding internal sequence number, which is then used as an entry in the validation program 105. The latter includes the shuffler 87 and the game data routine 89 which operate in the manner described above to generate the associated game data symbols, which can then be compared with those of the proferred ticket to validate it.

The validation method allows for either manual, semi-automatic or automatic entry of "serial number" data. Manual entry of data involves keypunch equipment. Semi-automatic entry of "serial number" data requires key-to-tape or key-to-disc data entry equipment. Automatic entry of Inventory Serial Number data requires optical character reading equipment. For either manual or semi-automatic data entry conventional computer print trains can be utilized. For automatic (e. e. OCR) data entry, a special print train with OCR type fonts is used during the second pass computer printing of the Inventory Serial Numbers. The validation program 105 produces a validation report 107 indicating whether or not the ticket is a winner.

Another portion of the computer control process (the ticket recovery program 111 causes the computer to reconstruct complete ticket data based on partial ticket information. That is, if a ticket holder presents a partially mutilated ticket 113, the computer can, if there is sufficient available data remaining on the ticket, be directed to reconstruct the original ticket for purposes of determining whether or not it is a winner. For example, if the lot number portion of the Inventory Serial Number and a portion of the game data have escaped mutilation, it is possible for the ticket recovery program 111 to reconstruct all of the tickets in that lot (in the same manner that the validation program 105 reproduces the tickets). The reconstructed tickets 115 of that lot can be compared item by item with the remaining information (game data symbols, other parts of the Inventory Serial Number, or the validation number, where it is used) available from the partially mutilated ticket. From these successive comparisons, the missing information may be restored and a unique identification achieved or a small number of possible alternative tickets can be identified.

Accordingly, a new and improved construction for an instant lottery ticket and for other playing cards used in games is provided by this invention. As a lottery ticket, the playing card has a high level of security against counterfeiting and fraudulent alteration, and is relatively inexpensive to manufacture by reason of an improved fabricating method. This fabricating method is also effective for playing cards of other types of games.

What is claimed is:

1. An instant lottery ticket construction for a game comprising:

a plurality of lots of tickets, each of said tickets being imprinted with a serial number, and imprinted with a lottery number seemingly randomly associated with the serial number, said lottery number being not discernible after the ticket is fabricated and when given to the player being transformable by the player to be intelligible for comparison with known winning lottery numbers set forth in the game in association with the tickets when dispensed to the player, the tickets for each of said lots being physically connected and disconnected when dispensed to the player;

said serial numbers being imprinted by means of a computer-controlled printer on successive ones of said lottery tickets with said serial numbers being sequential within each of said lots and providing an inventory control of the tickets in each of said lots;

said lottery numbers being imprinted by means of said printer on said lottery tickets with each of said lottery numbers being correlated seemingly randomly to the serial number of the same ticket by a certain computer algorithm of logical operations so that improperly altered or counterfeit lottery numbers can be detected by testing for correlation with the associated serial number; said physically connected tickets in said lots having a certain quantity of winning ones of said lottery numbers in a particular game, the winning lottery numbers being seemingly randomly distributed through said physically connected tickets of said lots without physical manipulation of said tickets and correlated with said serial numbers by a certain computer algorithm associated with said lottery number algorithm; whereby a highly reliable lottery is economically established in the ticket fabrication by the ability to validate winning lottery tickets, by the distribution and dispensing of tickets being accounted for by serial numbers, and by the assurance to players and ticket dispensers of a certain number of winning lottery tickets in seemingly random relation to non-winning tickets.

2. An instant lottery ticket construction as set forth in claim 1 wherein the lottery numbers of said lottery tickets are covered with a removable covering.

3. An instant lottery ticket construction as set forth in claim 1 wherein said lottery tickets are sales slips for commercial promotions.

4. An instant lottery ticket construction as set forth in claim 1 wherein said lottery tickets are commercial coupons.

5. An instant lottery ticket construction as set forth in claim 1 wherein said tickets in each of said lots are folded in a continuous strip and detached from said strip when dispensed.

6. An instant lottery ticket construction as recited in claim 5 and further comprising an additional validation number imprinted on each of said tickets and correlated seemingly randomly to the serial number of the same ticket by a certain computer algorithm so that improperly altered or counterfeit lottery tickets can be detected by testing for correlation of the serial and validation numbers thereof and partially mutilated tickets can be reconstructed by the correlating computer algorithms.

* * * * *